US005688212A

United States Patent [19]

Walker

[11] Patent Number: 5,688,212

[45] Date of Patent: Nov. 18, 1997

[54] ROTA-FLEX FREESTANDING ROTATIONAL MOTION AND RELATIVE DISPLACEMENT TRAINING APPARATUS

[76] Inventor: Guy M. Binx Walker, P.O. Box 681, Ocean Springs, Miss. 39566

[21] Appl. No.: 718,871

[22] Filed: Sep. 24, 1996

[51] Int. Cl.[6] ..... A63B 69/36

[52] U.S. Cl. ..... 482/83; 482/118; 473/215; 473/216

[58] Field of Search ..... 482/127, 148, 482/142, 123, 114, 83, 87, 90, 907, 904, 118; 473/216, 215, 277

[56] References Cited

U.S. PATENT DOCUMENTS

| | | | |
|---|---|---|---|
| 1,324,404 | 12/1919 | Metzger . | |
| 1,530,519 | 3/1925 | Remington | 473/216 |
| 1,561,960 | 11/1925 | Ungar | 473/216 |
| 3,415,524 | 12/1968 | Vickers . | |
| 3,768,808 | 10/1973 | Passera . | |
| 4,318,546 | 3/1982 | Chen | 473/216 |
| 4,408,759 | 10/1983 | Reneau et al. . | |
| 4,564,192 | 1/1986 | Lebowitz | 482/87 |
| 4,684,126 | 8/1987 | Dalebout et al. | 482/118 |
| 4,758,000 | 7/1988 | Cox | 473/215 |
| 5,024,443 | 6/1991 | Bellagamba . | |
| 5,048,836 | 9/1991 | Bellagamba . | |
| 5,156,402 | 10/1992 | Hart . | |
| 5,176,622 | 1/1993 | Anderson et al. . | |
| 5,282,776 | 2/1994 | Dalebout | 482/114 |
| 5,324,247 | 6/1994 | Lepley . | |
| 5,492,524 | 2/1996 | Marx . | |

*Primary Examiner*—Jerome Donnelly
*Attorney, Agent, or Firm*—Sherman and Shalloway

[57] ABSTRACT

The present invention provides a freestanding apparatus for demonstrating correct rotational movements of the body for different sports activities and for training an individual to perform such movements in the correct order and relative relationship. The apparatus comprises a vertical support having upper and lower rotational resistance assemblies which are vertically adjustable to be positioned at the user's pectoral and hip levels. The assemblies include mechanisms whereby the degree of resistance to rotational movement may be adjusted.

17 Claims, 3 Drawing Sheets

ROTA-FLEX FREESTANDING ROTATIONAL MOTION AND RELATIVE DISPLACEMENT TRAINING APPARATUS

FIELD OF THE INVENTION

The present invention provides a freestanding apparatus for demonstrating correct rotational movements of the body for different sports activities and for training an individual to perform such movements in the correct order and relative relationship. The apparatus comprises a vertical support having upper and lower rotational resistance assemblies which are vertically adjustable to be positioned at the user's pectoral and hip levels. The assemblies include mechanisms whereby the degree of resistance to rotational movement may be adjusted.

BACKGROUND OF THE INVENTION

Many sports activities depend on the relative rotation of the upper, mid and lower torso areas of the body. Sports such as golf, baseball, tennis, boxing, and the like involve rotational motion and relative displacement in correct order and degree in order to obtain the optimum power to a particular stroke as well as accuracy in the delivery.

The first part of developing such order and degree involves demonstrating to a student the correct relationship and displacement of the body portions. Such demonstration is often difficult in that the action happens quickly and the actual movements are not easy to separate for visual study. Once the movements have been demonstrated and understood, the student must then practice and train himself so that the respective muscle groups are exercised to the proper degree and so that the correct rotational sequence becomes an automatic reflex action.

Such demonstration, training and exercise are best achieved by placing the student in a situation which best approximates the conditions most conducive to correct motion. To that end, a device which selectively restricts and permits rotation of the upper body and hips in a particular sequence for the particular sport has been devised.

SUMMARY OF THE INVENTION

It is an object of the present invention to provide a device for use in demonstrating the correct order and relationship of rotation of the upper and lower torso for various sports.

It is a further object to provide a device for use in training and exercising the body to achieve the correct order and relationship of rotation of the body for various sports.

It is a still further object to provide such a device wherein the degree of resistance to rotation of the upper and lower torso in both the forward and backward directions is adjustable.

Further objects and advantages will become evident from the following drawings and descriptions.

The present invention provides a freestanding rotational motion and relative displacement training apparatus comprising a base assembly, a vertical support post extending upward from the base assembly, a first resistance assembly and a second resistance assembly each independently vertically adjustable along the support post. Each resistance assembly comprises left and right rotation arms independently rotatable about a cylindrical collar positioned on the post, with each rotation arm having a clamp mechanism whereby resistance to rotation of the arms about the collar is adjustable.

The present invention further provides a freestanding rotational motion and relative displacement training apparatus comprising; a base assembly; a vertical support post extending upward from the base assembly; a first resistance assembly vertically adjustable along the support post and comprising left and right horizontally extending rotation arms, a vertically elongated hip pad on each arm and adjustably positionable therealong, and a belt connecting outer ends of the arms across a user's pelvic area; and a second resistance assembly vertically adjustable along the support post above the first resistance assembly and comprising left and right horizontally extending rotation arms, an elongated pad on each arm and adjustably positionable therealong, each pad having an inward angle of about 30° to 60° from vertical to angle across a user's shoulder blades, and belt members extending from the lower end of one pad to the upper end of the other pad across the user's chest. The apparatus is effective in demonstrating correct rotational motion and relative displacement of a user's upper and lower torso during sports activities and in training the user to achieve such rotational motion and relative displacement.

The present invention still further provides a freestanding rotational motion and relative displacement training apparatus comprising; a base assembly; a vertical support post extending upward from the base assembly; a first resistance assembly vertically adjustable along the support post and comprising left and right horizontally extending rotation arms, a vertically elongated hip pad on each arm and adjustably positionable therealong, and a belt connecting outer ends of the arms across a user's pelvic area; and a second resistance assembly vertically adjustable along the support post above the first resistance assembly and comprising left and right horizontally extending rotation arms, an elongated pad on each arm and adjustably positionable therealong, each pad having an inward angle of about 30° to 60° from vertical to angle across a user's shoulder blades, and belt members extending from the lower end of one pad to the upper end of the other pad across the user's chest; wherein the base assembly comprises a foot plate having a central dihedral of ⅝": 12" and a knee target extending vertically upward parallel to the vertical support post.

DETAILED DESCRIPTION OF THE INVENTION

Figure 1:
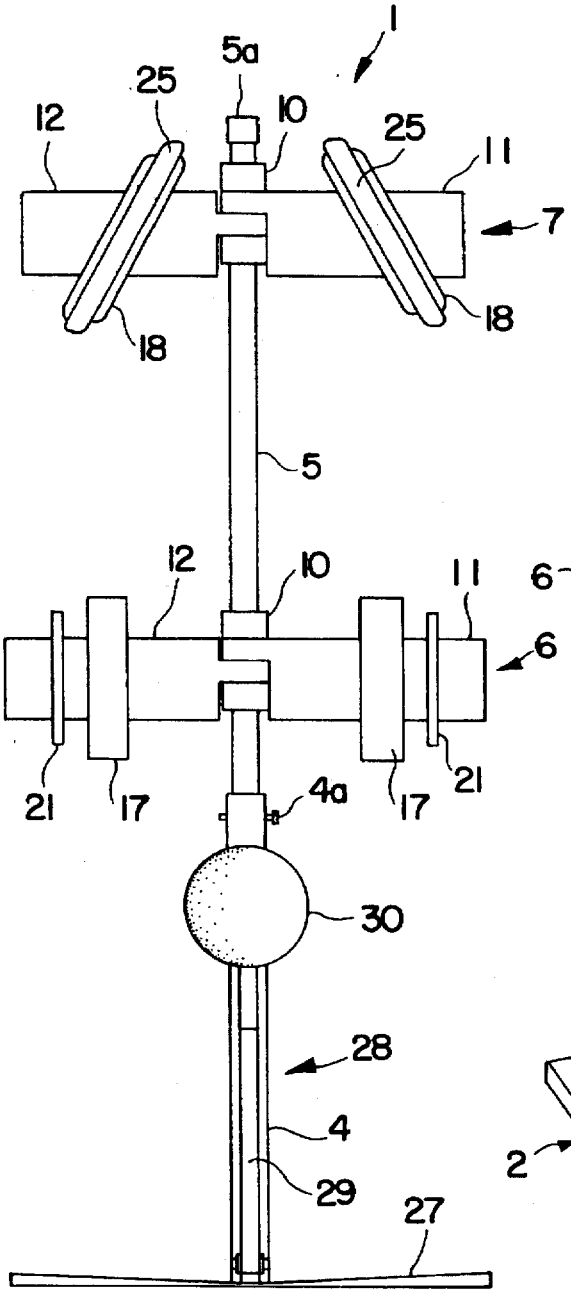
FIG. 1 is a front elevation of the apparatus of the invention.
Figure 2:
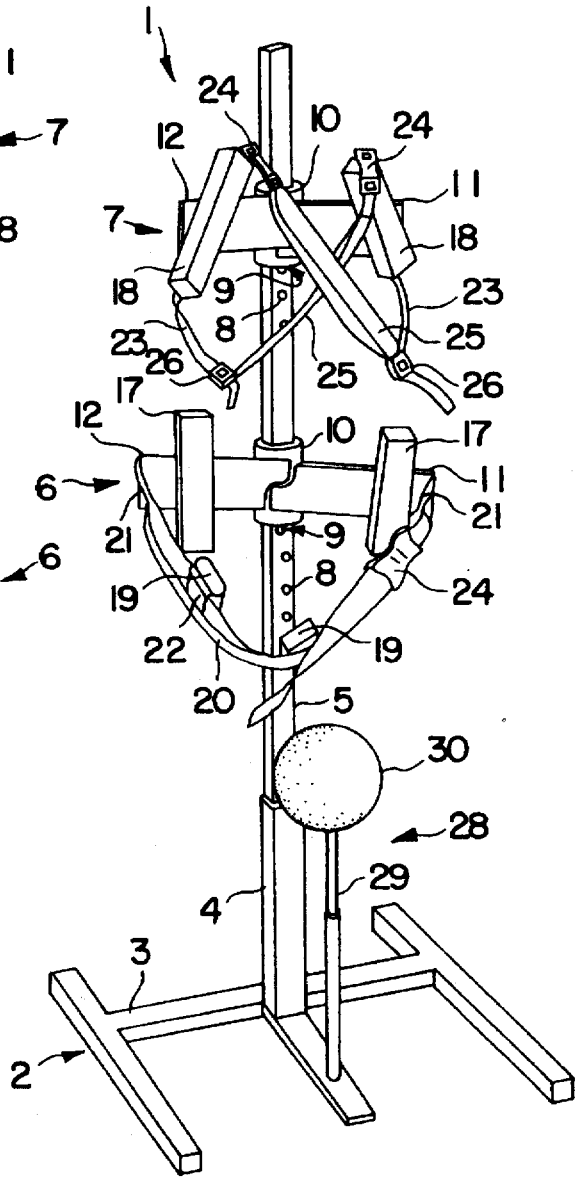
FIG. 2 is an oblique view of the apparatus of the invention.

The freestanding rotational motion and relative displacement training apparatus 1 is shown in FIGS. 1 and 2. The apparatus 1 includes a base assembly 2, a vertical support post 5 a first resistance assembly 6 and a second resistance assembly 7. In addition, for certain demonstrations and exercises, the apparatus 1 includes a foot plate 27 and a knee target 28. The elements of the apparatus may be manufactured from a variety of materials including steel, aluminum, fiber reinforced composites, PVC piping, and the like. The need for strength and rigidity may determine the nature of the actual material used. Also, a certain degree of base weight is considered desirable to prevent a user from inadvertently pulling the apparatus over during use.

Base assembly 2 consists of a horizontal support 3 which is shown as an H-shape consisting of two parallel members and a cross member. Other arrangements or structures for the base assembly may be used so long as they provide sufficient stability for the apparatus 1. Attached centrally to the horizontal support is vertical stanchion 4 which is preferably a hollow tube into which the end of the vertical support post 5 is inserted. The fit of support post 5 into stanchion 4 is such that they are not relatively rotatable. This may be achieved by means of a locking pin 4*a* passing through aligned holes in both the stanchion 4 and post 5 as shown in FIG. 1, or by manufacturing both the stanchion 4 and post 5 from stock having a square cross section wherein the inside dimension of the stanchion 4 is the equivalent of the outside dimension of the post 5 as shown in FIG. 2.

Vertical support post 5 extends upwardly from stanchion 4 a distance which is equivalent to at least the height of a person's shoulders and, preferably, is capped with a protective cap 5*a*. Equally spaced along the length of vertical support post 5 are a plurality of assembly adjustment holes 8 which receive adjustment pins 9 to provide vertical adjustment of first and second resistance assemblies 6 and 7 along vertical support post 5.

First resistance assembly 6 is positioned lower most on vertical support post 5 with second resistance assembly uppermost. Each assembly comprises a collar 10 having a cylindrical outer surface which is slidable along post 5 but which is prevented from rotating about post 5, and a pair of rotation arms 11 and 12. Where post 5 has a square cross section, rotation of collar 10 about post 5 may be prevented by providing collar 10 with an inside dimension which is substantially the same as the outside dimension of post 5. Alternatively, where post 5 has a round cross section, collar 10 may be prevented from rotating about post 5 by means of adjustment pin 9 engaging a detent in the lower edge of collar 10 or by providing a cooperating hole in collar 10 through which pin 9 is inserted into the adjustment holes 8.

Figure 3:
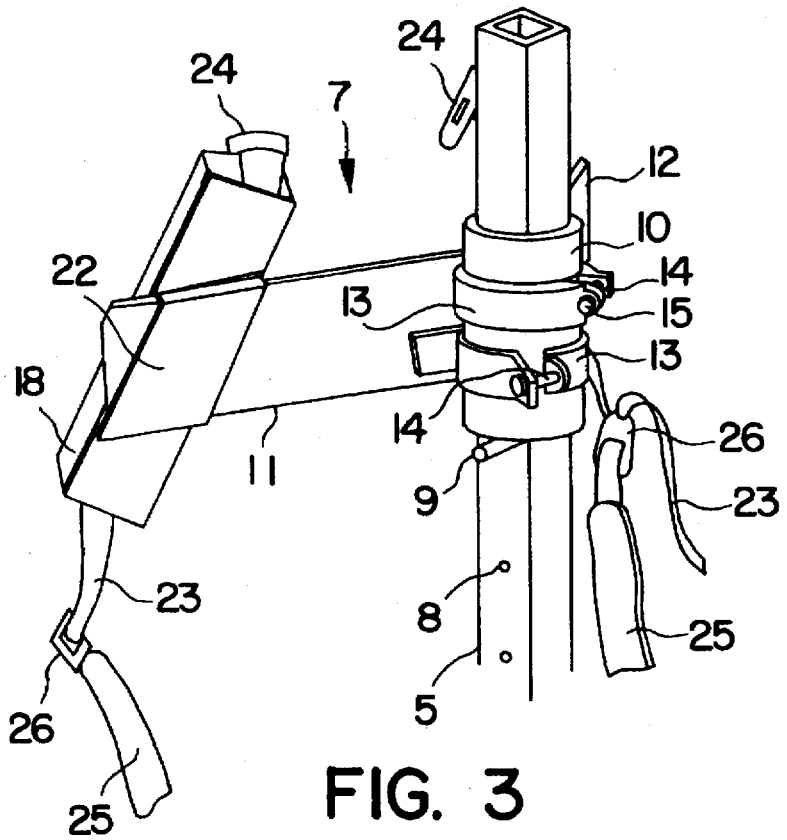
FIG. 3 is a detail view of the rear side of a rotational resistance assembly of the present invention.
Figure 4:
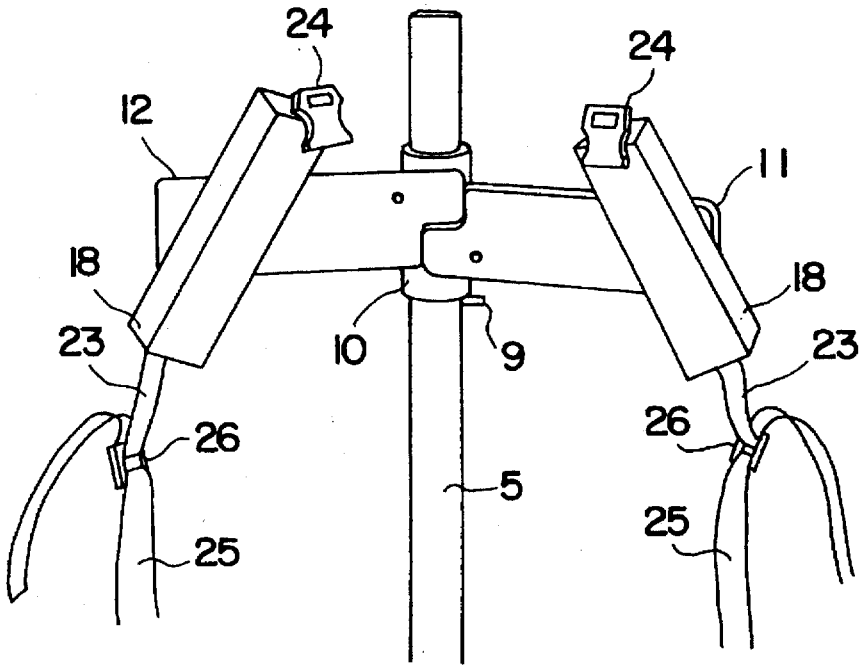
FIG. 4 is a front view of the rotational resistance assembly of FIG. 3.
Figure 5:
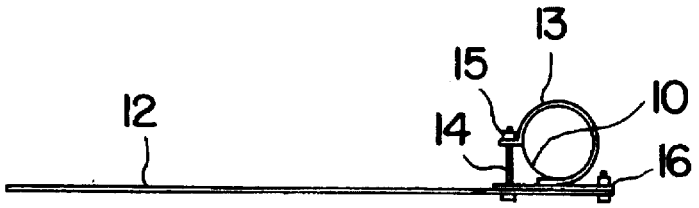
FIG. 5. is an overhead view of a rotation arm of the apparatus showing an alternative adjustable resistance mechanism.
Figure 6:
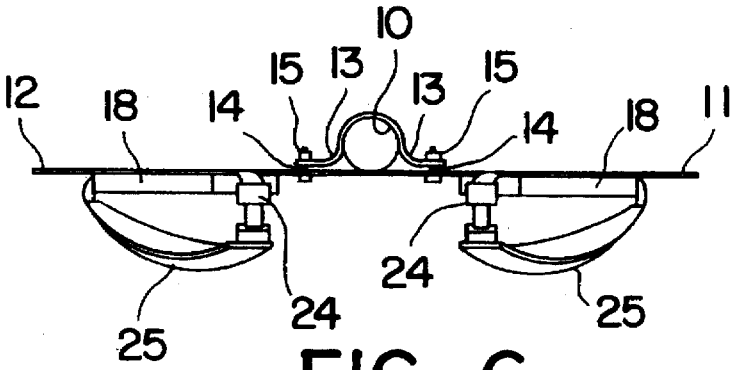
FIG. 6 is an overhead view of a rotational resistance assembly of the apparatus illustrating an alternative construction.

Collar 10 provides a vertically adjustable cylindrical body about which rotation arms 11 and 12 may rotate. Rotation arms 11 and 12 extend substantially perpendicularly from vertical support post 5 and are each mounted on collar 10 by means of resistance clamps 13 which control the relative resistance to rotation of arms 11 and 12 about the vertical axis of support post 5. This assembly is best shown in FIG. 3. Clamps 13 comprise C-shaped members which fit around collar 10 and have appropriate mechanisms whereby the ends of the members may be drawn together to exert a clamping force against the outer surface of collar 10. Clamps 13 may be separate elements attached to arms 11 and 12 by means of welding, a plate or similar structure 16, as shown in FIGS. 3 and 5, or clamps 13 may be formed as extensions of arms 11 and 12 which wrap around collar 10, as shown in FIG. 6.

Clamps 13 provide resistance to rotation of arms 11 and 12 and to that end include a mechanism for adjusting the clamping force around collar 10. Preferably, the adjustment mechanism consists of an adjustment screw 14 extending from one end of clamp 13 and cooperating with an adjustment nut 15 fixed to the other end of clamp 13. Tightening of screw 14 with respect to nut 15 increases the clamping force of clamp 13 about collar 10 thereby increasing the resistance to rotation of arms 11 and 12. Conversely, loosening screw 14 will reduce the clamping force and, thereby, the resistance to rotation. Clamp 13 may be provided on its inner surface with a uniform layer of material such as felt, high density foam, or the like providing a friction surface for better control over rotation resistance.

Figure 7:
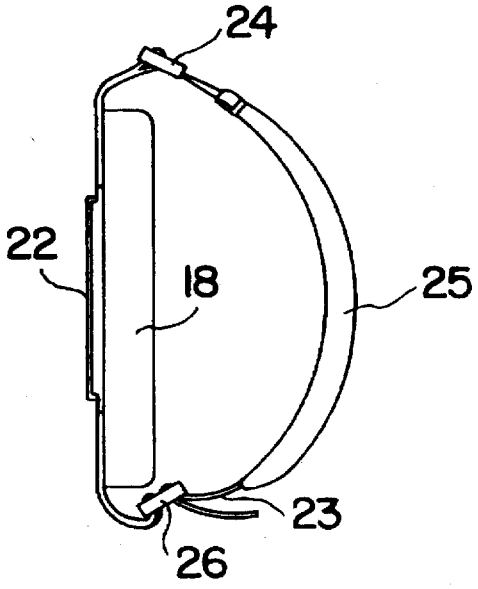
FIG. 7 is a side elevation of a pad of the apparatus.

First resistance assembly 6 is positioned on support post 5 at a level corresponding to a user's hips and includes hip pads 17 horizontally, slidably positionable on each arm 11 and 12. Pads 17 are vertically elongated and are positionable to engage the user at that point on the back of the hips that forces pressure to rotate arms 11 and 12 backward. To this end, pads 17 are each provided with a back having a bracket 22 which slidably engages arms 11 and 12 as shown in FIGS. 3 and 7 in relation to similar pads 18 provided on arms 11 and 12 of second resistance assembly 7. Preferably, the fit of bracket 22 over arms 11 and 12 is such that the pads will not be inadvertently moved out of place while the apparatus 1 is in use but may be readily adjusted for different users. Friction materials may be applied to the inner surface of bracket 22 to achieve this result.

The training exercises performed with the apparatus 1 involve rotation in both the forward and rearward directions. accordingly, first resistance assembly 6 includes a hip belt 20 which connects the outer ends of arms 11 and 12 across the pelvis of the user. The two halves of hip belt 20 may be directly connected to arms 11 and 12 or attached by means of D-rings 21 fixed to arms 11 and 12. A buckle 24 and length adjustment mechanism are provided on hip belt 20 as are a pair of frontal hip pads 19 which include a bracket 22 and, like pads 17, are slidably adjustable along belt 20 so as to be positioned at the front of the hips at that point at which the hips rotate forward. Forward rotation of the hips presses against one or the other of pads 19 exerting pressure on belt 20 thereby pulling the appropriate arm 11 or 12 forward.

Second resistance assembly 7 is positioned on support post 5 above first resistance assembly 6 and at a level corresponding to the level of the user's arm pits. Like first resistance assembly 6, second resistance assembly 7 comprises collar 10, left and right rotation arms 11 and 12, and adjustable clamps 13. Second resistance assembly 7 further includes pectoral pads 18 which are substantially identical to the hip pads 17 of first resistance assembly 6 except for being angled inwardly by about 30° to about 60° from vertical. Thus, when second resistance assembly is properly positioned, pads 18 are positioned diagonally across the user's shoulder blades from the latissimus to the clavicle so that pressure for rearward rotation is exerted by the back rather than the shoulders. Pads 18 are slidably adjustable along arms 11 and 12 of second resistance assembly 7.

As shown in FIGS. 2, 6 and 7, pectoral pads 19 are provided with belts 23 which include buckles 24 front pectoral pads 25 and adjustment slides 26. By means of belts 23, buckles 24, and slides 26, front pectoral pads 25 are positioned across the chest of the user. As with the belt 20 and frontal hip pads 19, the belts 23 and front pectoral pads 25 provide a means whereby forward rotation of the upper body pulls the appropriate arm 11 or 12 forward. The preferred arrangement of belts 23 and pads 25 with respect to pads 18 is as shown in FIGS. 6 and 7 wherein the belt 23 and pad 25 are buckled to the same pad 18 to which they are fixed. In an alternative arrangement shown in FIG. 2, the pads 25 may be criss-crossed from one pad 18 to the other pad 18 of second resistance assembly 7 across the user's sternum.

Base assembly 2 preferably includes a foot plate 27 which covers the forward portion of base assembly 2 and on which the user stands thus providing additional stability to the apparatus. In order to induce proper knee rotation relative to hip rotation, foot plate 27 comprises left and right planes which meet along a center line perpendicular to the vertical support post 5 to form a ⅝":12" dihedral as shown in FIG. 1. Knee target 28 rises from this dihedral and comprises an adjustable pole 29 having a sphere 30 mounted on its upper end. Pole 29 is positioned parallel to vertical support post 5 and spaced therefrom a distance of from about 12" to about 15". Pole 29 is preferably vertically adjustable from a height of about 12" to a height of about 24". Sphere 30 has a diameter of about 7" and is fixed to the upper end of pole 29. Sphere 30 is preferably manufactured from a lightweight rigid foam so as to provide a surface against which the knees are alternately pressured as the hips are rotated.

In use the user adjusts the level of the first and second resistance assemblies so that the first assembly 6 is positioned at the level of the hips and the second assembly 7 is positioned at arm pit level. Pins 9 are inserted into appropriate holes 8 to secure assemblies 6 and 7 at the correct heights. The user then stands against the apparatus 1 with his spine parallel to vertical support post 5 while pads 17 and 18 of assemblies 6 and 7 are adjusted and hip strap 20 is buckled about his pelvis with the frontal hip pads 19 positioned at the front edges of his pelvis. Shoulder belts 23 and front pectoral pads 25 are buckled into place to secure second resistance assembly. If knee target 28 is to be used, it is adjusted to the correct height for the user's knees.

Since the first and second assemblies operate independent of each other, it is possible to separately control the actions of the upper body and the hips. In addition, since the left and right rotation arms 11 and 12 of each resistance assembly 6 and 7 have separate clamps 13, it is possible to separately control the actions of the left and right sides of the upper body and hips. In this manner, the apparatus may be adjusted to demonstrate to a user the correct sequence of body rotation for a particular activity whereby the user may then train himself to properly execute that sequence.

For example, in skiing, when a skier traverses a steep slope, the upper body should remain firmly perpendicular to the fall line of the slope while the hips pivot from left to right. The apparatus 1 of this invention is suitable for demonstrating and practicing the correct movements for this activity by tightening the clamps 13 of second resistance assembly 7 to prevent any rotation of the upper body while arms 11 and 12 of first resistance assembly 6 are allowed to rotate. In this manner, the upper body is held still simulating the proper condition for traversing a ski slope and allowing the user to concentrate on training the lower body to accomplish the proper hip swings necessary for the activity. Tightening the clamps 13 of first resistance assembly 6 adds resistance to rotation thereby providing a force against which the muscles of the back must work to effect the hip swings. In this manner, the user can exercise and build up those muscles through training.

Similarly, in the sport of skating, as the hips drive the right foot, the upper body swings equally hard to the left and when the left foot is driven, the upper body swings to the right. Over or under rotation of the upper or lower body can upset this sequence of movement. By adjusting the clamps 13 of the first and second resistance assemblies 6 and 7, any tendencies to over or under rotate either the hips of the upper body may be controlled thereby providing demonstration of and training to achieve the correct relative displacement of the upper and lower body for greater efficiency and power in each stride.

A ripple exercise with the apparatus 1 is used to demonstrate and develop the sequence of hip rotation, body rotation and shoulder reversal which is a fundamental sequence for many sports actions such as throwing, batting, serving a tennis ball, driving a golf ball from a tee, or the like. To begin the exercise, the hips, first resistance assembly, body and second resistance assembly are centered. With the knee target properly adjusted, the "windup" or back swing commences with the shoulders rotating completely to the right while the body and hips remain centered. To assist in maintaining the hips in position while the shoulders rotate, the clamps 13 of the first resistance assembly 6 may be tightened so as to provide greater resistance than the clamps 13 of the second assembly 7. After the shoulders, the mid-torso is rotated while the hips remain centered until the body-hip relationship approaches 90°. Finally, the feet and legs rotate the hips around until the right knee holds a "knock-kneed" position over the instep of the right foot and the left knee has rotated the left hip forward and comes to rest at the knee target. The dihedral of foot plate 27 helps to demonstrate and train the user to effect the proper knee position.

When the "swing" or reverse rotation commences, the hips first rotate left past the center to a focus point on the left foot. The right knee moves forward toward the central knee target pulling the right hip around and completing hip rotation. The body rotates after the hips to align with the hips. At the instant of this alignment, an upward pulse from the left foot triggers the left shoulder to initiate shoulder rotation which passes through center to then lead the body and hips in a completion of the follow through.

Proper adjustment of the clamps 13 of the arms 11 and 12 of assemblies 6 and 7 provides the apparatus 1 with the ability both to demonstrate the proper sequence of events for an activity and to train the user to perform the correct rotation sequences by controlling the resistance to rotation of one portion of the body relative to others.

The above embodiments and drawings illustrate the preferred embodiments of the present invention and it is understood that many variations and modifications of those embodiments will be evident to those skilled in the art and may be carried out without departing from the spirit and scope of the present invention.

What is claimed is:

1. A freestanding rotational motion and relative displacement training apparatus comprising a base assembly, a vertical support post extending upward from said base assembly, a first resistance assembly and a second resistance assembly each independently vertically adjustable along said support post wherein each resistance assembly comprises left and right rotation arms independently rotatable about a cylindrical collar positioned on said post said left and right rotation arm including user engagement means, each rotation arm having a clamp mechanism whereby resistance to rotation by said rotation arms is adjustable; whereby said apparatus is effective in demonstrating correct rotational motion and relative displacement of a user's upper and lower torso during different sports activities and in training said user's to achieve correct rotational movement and relative displacement of the upper and lower torso.

2. The apparatus of claim 1 wherein said user engagement means comprises vertically elongated pads horizontally adjustable on said rotation arms.

3. The apparatus of claim 2 wherein said pads on said second resistance assembly have an inward angle of from 30° to 60° from vertical.

4. The apparatus of claim 3 further comprising belt members on each resistance assembly capable of being fastened about a user whereby said rotation arms are attached to said user, said belt members including adjustable buckles and pad members.

5. The apparatus of claim 4 wherein the pad members on the belt of said first assembly are adjustable along said belt.

6. The apparatus of claim 1 further comprising a foot plate on said base assembly, said foot plate forming a ⅝":12" dihedral along a center line perpendicular to said vertical support post.

7. The apparatus of claim 1 further comprising a knee target vertically parallel to said vertical support post and spaced from 12" to 15" from said post.

8. The apparatus of claim 7 wherein said knee target comprises a vertically adjustable pole having a sphere attached to the upper end thereof.

9. A freestanding rotational motion and relative displacement training apparatus comprising;

a base assembly;

a vertical support post affixed to an extending upwardly from said base assembly;

a first resistance assembly vertically adjustable along said support post and comprising left and right independently rotatable horizontally extending rotation arms, a vertically elongated hip pad on each arm and adjustably positionable therealong, and a belt connecting outer ends of said arms across a user's pelvic area; and a second resistance assembly vertically adjustable along said support post above said first resistance assembly and comprising left and right independently rotatable horizontally extending rotation arms, an elongated pad on each arm and adjustably positionable therealong, each pad having an inward angle of from about 30° to about 60° from vertical to angle across a user's shoulder blades, and belt members extending from the lower end to the upper end of each pad across the user's chest;

whereby said apparatus is effective in demonstrating correct rotational motion and relative displacement of said user's upper and lower torso during certain activities and in training said user to achieve correct rotational motion and relative displacement of the upper and lower torso.

10. The apparatus of claim 9 wherein said base assembly comprises a foot plate extending in front of said vertical post, said foot plate comprising left and right planes meeting along a center line perpendicular to said vertical support post and forming a ⅝":12" dihedral.

11. The apparatus of claim 9 further comprising a knee target parallel to said vertical support post and spaced therefrom a distance of from 12" to 15".

12. The apparatus of claim 11 wherein said knee target is vertically adjustable from a height of about 12" to a height of about 24" and comprises a sphere having a diameter of about 7".

13. The apparatus of claim 9 further comprising adjustable mechanisms associated with each rotation arm of each resistance assembly whereby resistance to rotation of each arm is independently adjustable.

14. The apparatus of claim 13 wherein said adjustable mechanism of each resistance assembly comprises a cylindrical collar slidably positionable on said vertical support post and fixed against rotation thereon and a resistance clamp attached to each of said rotation arms and encircling said collar, said clamp having an adjusting screw whereby clamping force of said clamp about said collar is adjustable and corresponds to the degree of resistance to rotation of said arm.

15. The apparatus of claim 9 further comprising pad members adjustably positionable on said belt of said first resistance assembly.

16. The apparatus of claim 9 further comprising pad members on said belt members of said second resistance assembly.

17. The apparatus of claim 12 wherein said sphere is fabricated from a rigid foam.

* * * * *